United States Patent [19]

Abe et al.

[11] 4,184,323

[45] Jan. 22, 1980

[54] METHOD AND APPARATUS FOR RECOVERING ENERGY POSSESSED BY EXHAUST GAS FROM BLAST FURNACE BY TURBINE

[75] Inventors: Setsuo Abe, Tokyo; Tomomi Asakura, Kisarazu; Takeshi Shirato; Motomasa Miyake, both of Tamano, all of Japan

[73] Assignees: Mitsui Engineering & Shipbuilding Co., Ltd.; Nippon Steel Corporation, both of Tokyo, Japan

[21] Appl. No.: 862,588

[22] Filed: Dec. 20, 1977

[30] Foreign Application Priority Data

Dec. 20, 1976 [JP] Japan ..... 51/153984

[51] Int. Cl.[2] ..... F02C 9/02

[52] U.S. Cl. ..... 60/39.03; 60/39.25

[58] Field of Search ..... 60/39.03, 39.25

[56] References Cited

U.S. PATENT DOCUMENTS

| | | | |
|---|---|---|---|
| 3,990,230 | 11/1976 | Kuwashima et al. | 60/39.03 |
| 4,069,660 | 1/1978 | Inubushi et al. | 60/39.25 |
| 4,072,006 | 2/1978 | Inubushi et al. | 60/39.25 |

FOREIGN PATENT DOCUMENTS

| | | | |
|---|---|---|---|
| 47-18321 | of 1972 | Japan | 60/39.25 |

*Primary Examiner*—Robert E. Garrett

*Attorney, Agent, or Firm*—Armstrong, Nikaido, Marmelstein & Kubovcik

[57] ABSTRACT

Method and apparatus for recovering heat energy and kinetic energy of a gas discharged from the top of a blast furnace effectively as electric energy or other energy by a turbine and a control mechanism. An exhaust gas is supplied to a septum valve and then into a turbine connected in parallel, and the capacity or design value of the turbine is set at a mean value of the total flow rate of the exhaust gas varying with the lapse of time during the normal steady operation of the blast furnace. When the total flow rate of the exhaust gas is lower than the mean value, all the exhaust gas is supplied to the turbine to recover the energy of the exhaust gas and the top pressure of the furnace is controlled by a governor valve regulating the speed of the turbine. On the other hand, when the total flow rate of the exhaust gas is higher than the mean value, a part of the exhaust gas corresponding to the mean value of the flow rate is supplied to the turbine to recover the energy of the exhaust gas, while the remaining part of the exhaust gas corresponding to the excess over the mean value is supplied to the septum valve and the top pressure of the blast furnace is controlled by the septum valve.

7 Claims, 4 Drawing Figures

METHOD AND APPARATUS FOR RECOVERING ENERGY POSSESSED BY EXHAUST GAS FROM BLAST FURNACE BY TURBINE

BACKGROUND OF THE INVENTION

The present invention relates to a method and apparatus for recovering heat energy and kinetic energy possessed by a gas discharged from the top of a blast furnace by supplying this exhaust gas to a turbine and converting the heat energy and kinetic energy to an electric energy by a generator driven by the turbine.

A gas discharged from the top of a blast furnace has large quantities of heat energy and kinetic energy, and it is desired to recover such energies effectively without wasteful discharge and use them as the power for other purposes.

According to the conventional method and apparatus for recovering the energy of this exhaust gas, a gas discharged from a blast furnace is passed through a dust precipitator to remove dust therefrom, the cleaned exhaust gas is branched into a septum valve and a turbine, and the energy is recovered as electric energy by driving a generator driven by the turbine while the top pressure of the blast furnace is being controlled by the septum valve. In this conventional technique the flow rates of the exhaust gas supplied to the septum valve and into the turbine are set according to two methods. Even during the normal steady operation of the blast furnace, the flow rate of the exhaust gas discharged from the top of the blast furnace gas varies with the lapse of time. According to the first method, the capacity of the turbine is set at the minimum value of the bottom which is not influenced by the variation of the total flow rate of the exhaust gas, namely at a level indicated by line A—A of FIG. 1. An excess portion of the exhaust gas exceeding the capacity of the turbine is supplied to the septum valve and the flow rate is controlled by the septum valve so as to maintain a necessary top pressure. According to the second method, the flow rate of the exhaust gas supplied to the turbine, namely the capacity of the turbine, is set at a maximum value among varying values of the total flow rates of the exhaust gas, namely at a level indicated by line B—B in FIG. 2. The top pressure is controlled by governor valve controlling the flow rate of the exhaust gas supplied to the turbine, and the septum valve is disposed merely to cope with blow-by or is used only when the turbine is stopped.

In the first method, the system can be controlled relatively easily, but since the quantity of the exhaust gas flowing in the septum valve is large, the quantity of the exhaust gas discharged without recovery of energy is increased. Therefore, the ratio of energy recovered by the turbine is low.

In the second method, when the flow rate of the exhaust gas varies and the flow rate of the gas flowing into the turbine is lower than the capacity of the turbine, in order to maintain the top pressure at a desirable level, it is necessary to throttle the flow of the gas. In this case, the loss of the gas by throttling is large and the energy recovery ratio is rather reduced. Especially when the blast furnace should be operated at a low operation rate over a period of a long time, this reduction of the energy recovery ratio is conspicuous. Moreover, since the planned capacity of the turbine becomes larger, the dimension of the turbine should be increased and hence, also dimensions of accessory equipments should inevitably be increased, resulting in increase of the equipment cost.

SUMMARY OF THE INVENTION

It is a primary object of the present invention to provide an energy recovery method and apparatus in which the capacity of the turbine for recovering energy of an exhaust gas is set at a mean value of the total flow rate of the exhaust gas varying with the lapse of time during the normal steady operation of a blast furnace, whereby the quantity of energy recovered by the turbine is increased.

A second object of the present invention is to provide an energy recovery method and apparatus in which the ratio of the recovered energy to the set capacity of a turbine is enhanced.

A third object of the present invention is to provide an energy recovery method and apparatus in which the flow rate of the exhaust gas not passing through a turbine but through a septum valve is reduced and the quantity of the energy not recovered but discharged wastefully is decreased.

A fourth object of the present invention is to provide an energy recovery method and apparatus in which when the flow rate of the exhaust gas is reduced below the set capacity of the turbine, throttling of the gas flow by a governor valve of a turbine is maintained at a low level to reduce the loss occurred by throttling.

Other objects, features and effects of the present invention will become apparent from the detailed description given hereinafter.

DETAILED DESCRIPTION OF PREFERRED EMBODIMENTS

The present invention will now be described by reference to the accompanying drawings.

Figure 1:
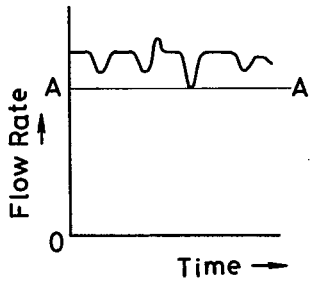
Fig. 1 PRIOR ART
FIG. 1 is a diagram, illustrating the relation among the total flow rate of the exhaust gas, its variation and the turbine capacity in one conventional method for recovering energy from the exhaust gas discharged from a blast furnace by using a turbine.
Figure 2:
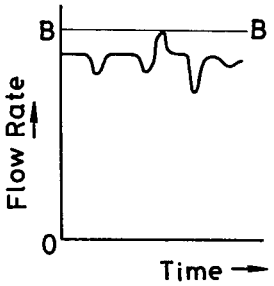
Fig. 2 PRIOR ART
FIG. 2 is a diagram, illustrating the relation among the total flow rate of the exhaust gas, its variation and the turbine capacity in another conventional method for recovering energy from the exhaust gas discharged from a blast furnace by using a turbine.
Figure 3:
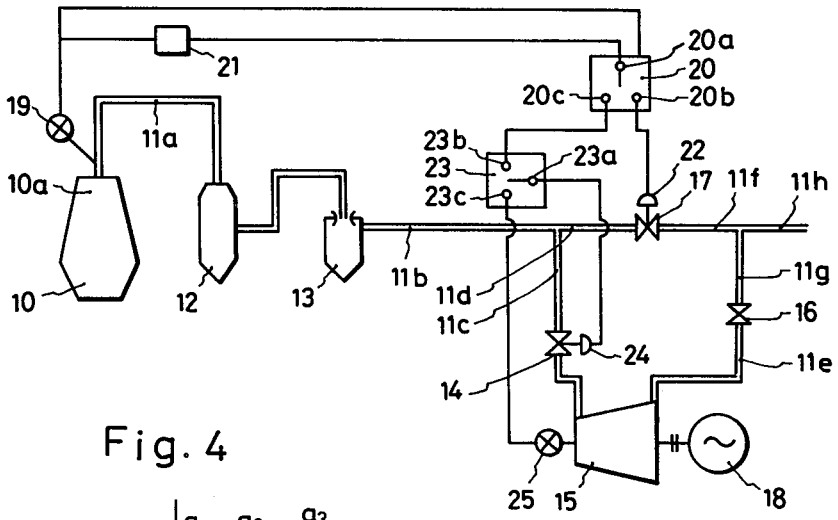
FIG. 3 is a diagram, illustrating one embodiment of the present invention.

Referring to FIG. 3, an exhaust gas is supplied from the top 10*a* of a blast furnace 10 into a dust collector 12 and a venturi scrubber 13 through a piping 11*a*, and dusts in the exhaust gas are removed by these dust collector 12 and venturi scrubber 13. A piping 11*b* from the scrubber 13 is branched into pipings 11*c* and 11*d*. One piping 11*c* is connected to a turbine 15 through a governor valve 14. The exit side of the turbine 15 is connected to a cut-off valve 16 through a piping 11*e*. The other piping 11*d* is connected to a septum valve 17, and the exit side of the septum valve 17 is connected to a piping 11*f*. This piping 11*f* is coupled with a piping 11*g* on the exit side of the above-mentioned cut-off valve 16 to form a piping 11*h* which is connected to a gas holder. A generator 18 is connected to the output shaft of the turbine 15.

A first oscillator 19 is disposed on the top 10*a* of the blast furnace 10 to detect the top pressure and emit an electric signal depending on the detected top pressure value. The first oscillator 19 is electrically connected to a first signal changeover device 20 which is arranged so that a contact 20*a* is selectively connected to a contact 20*b* or contact 20*c*. In this first signal changeover device, upper and lower limits of allowable variations of the top pressure with a certain narrow width are set. When the top pressure exceeds the upper limit, the contact 20*a* is automatically connected to the contact 20*b*, and when the top pressure becomes lower than the lower limit, it is automatically changed over to the contact 20*c*. While the contact 20*a* is connected to the contact 20*b*, the connection can be manually locked or unlocked. An electric signal from the first oscillator 19 is converted to a control signal by a pressure governor 21, and the control signal from the pressure governor 21 is supplied to the septum valve 17 or governor valve 14 through the first signal changeover device 20 to control the top pressure.

The contact 20*b* of the first signal changeover device 20 is connected to a mechanism 22 for operating the septum valve 17. The contact 20*c* is connected to a contact 23*b* of a second signal changeover device 23. This second signal changeover device 23 has contacts 23*a* and 23*c* in addition to the contact 23*b*. The contact 23*a* is selectively connected to the contact 23*b* or contact 23*c* automatically. The contact 23*a* is connected to a mechanism 24 for operating the governor valve 14, and the contact 23*c* is connected to a second oscillator 25 which detects the rotation number of the turbine 15 and emits a signal depending on the detected rotation number.

Figure 4:
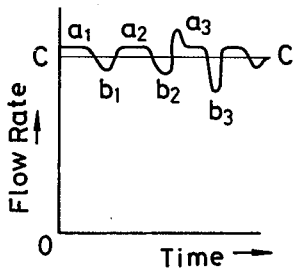
FIG. 4 is a diagram, illustrating the relation among the total flow rate of the exhaust gas, its variation and the turbine capacity in the present invention.

The capacity of turbine 15 is set at a mean value of the total flow rate of the exhaust gas varying with the lapse of time, namely at a level indicated by line C—C in FIG. 4. The above-mentioned upper and lower limits of the pressure set in advance in the first signal changeover device 20 are determined so that they are equal to a pressure level slightly higher than the pressure corresponding to the turbine capacity, i.e., the above mean value, and a pressure level slightly lower than the pressure corresponding to the turbine capacity, respectively.

The operation of the apparatus of the present invention having the above-mentioned structure will now be described.

When both the governor valve 14 and the cut-off valve 16 are closed, the turbine 15 is stopped and all the exhaust gas passes through the septum valve 17. When the contact 20*a* is connected to the contact 20*b* in the first signal changeover device 20 and this connection is locked the electric signal from the first oscillator 19 is supplied to the pressure governor 21 where the signal is compared and operations such as subtraction, proportion and integration are conducted. The resulting output signal of the pressure governor 21 is supplied to the septum valve 17 to control the top pressure. During this process, no energy is recovered by the turbine 15.

When the turbine 15 is started, the cut-off valve 16 is opened and a dial of the second oscillator 25 is set at a start position. At this point, the contact 23*a* is connected to the contact 23*c* in the second signal changeover device 23, and the governor valve 14 is gradually opened to start the turbine 15. Then, the second oscillator 25 is adjusted so that the rotation of the turbine 15 becomes synchronous with a power bus bar, and the power of the generator 18 is invested into the power bus bar. Then, the connection between the contact 20*a* and contact 20*b* is unlocked in the first signal changeover device 20, and the second oscillator 25 is adjusted so that the output of the generator 18 is increased. As a result, the contact 23*a* is automatically changed over to the contact 23*b* in the second signal changeover device 23. Thus, the apparatus system is placed in the state where the system can be automatically controlled.

A signal depending on the top pressure is supplied from the first oscillator 19 to the first signal changeover device 20 where the signal is compared with the predetermined upper and lower limits. When the top pressure is lower than the lower limit, a mean value of the total flow rate of the exhaust gas varying with the lapse of time is lower than the capacity of the turbine 15. In this case, in the first signal changeover device 20, the contact 20*a* is automatically connected to the contact 20*c*, and the septum valve 17 is closed and all the exhaust gas is supplied to the turbine 15 through the governor valve 14. The generator 18 is driven by the turbine 15, and the energy of the exhaust gas is converted to electric energy and is recovered in the state invested in the power bus bar. The top pressure is detected by the first oscillator 19 and transmitted to the pressure governor 21, where the top pressure signal is converted to a control signal. This control signal is transmitted to the governor-valve operating mechanism 24 through the first signal changeover device 20 and second signal changeover device 23. The governor-valve operating mechanism 24 drives the governor valve 14 to adjust the quantity of the exhaust gas supplied to the turbine 15 and thereby control the top pressure.

When the top pressure exceeds the upper limit set in advance in the first signal changeover device 20, the contact 20*a* which has been connected to the contact 20*c* is automatically changed over to the contact 20*b* in the first signal changeover device 20. In this state, the flow rate of the exhaust gas supplied to the turbine 15 corresponds fully to the capacity of the turbine 15, and the excessive portion of the exhaust gas over the capacity of the turbine 15 is flown into the septum valve 17. The top pressure is maintained at the predetermined level by the septum valve 17 through the pressure governor 21, first signal changeover device 20 and septum-valve operating mechanism 22 depending on the signal from the first oscillator 19.

In the present invention, the capacity of the turbine, namelythe level indicated by line C—C in FIG. 4, may be determined so that the area defined by the line C—C and the portion of the flow rate curve above the line C—C is equal to the area defined by the line C—C and the portion of the flow rate curve below the line C—C. Also the capacity of the turbine 15 may be determined based on a mean value of peaks $a_1$, $a_2$, $a_3$, . . . and troughs $b_1$, $b_2$, $b_3$, . . . in the flow rate curve. No substantial difference of the energy recovery ratio by the turbine is caused whether the capacity of the turbine may be determined according to the first-mentioned method or according to the latter method.

In the foregoing embodiment, a method and apparatus for recovering energy possessed by an exhaust gas by converting it to electric energy by a generator connected to the turbine have been illustrated. In the present invention, the energy of the exhaust gas can be recovered in other forms by using a compressor and/or pump connected to the turbine.

What is claimed is:

1. A method for recovering energy of an exhaust gas from the top of a blast furnace comprising removing dusts from said exhaust gas by a dust precipitator, branching the dust-removed exhaust gas into two gas streams, supplying one stream to a septum valve while supplying the other stream to a turbine, and recovering the energy of the exhaust gas by a generator connected to the turbine while controlling the top pressure of the blast furnace depending on the flow rate of the exhaust gas passing through the septum valve and/or turbine, said energy recovery method being characterized in that the turbine capacity is set at a predetermined mean flow rate of the exhaust gas and a mechanism for operating said septum valve and a governor valve for the turbine are connected selectively exchangeably in response to a signal indicating the top pressure of the blast furnace which corresponds to the flow rate of the exhaust gas at the furnace top so that when the flow rate of the exhaust gas is lower than said mean value, the septum valve is completely closed to supply all the exhaust gas to the turbine while controlling the top pressure by the governor valve of the turbine and that when the flow rate of the exhaust gas is higher than said mean value, the exhaust gas in an amount corresponding to said mean value is supplied to the turbine and the remaining excessive portion of the exhaust gas is caused to pass through the septum valve while controlling the top pressure by the septum valve, whereby the energy of the exhaust gas is also used to drive not only a generator but also other rotating machines such as a compressor or pump connected to the turbine.

2. An apparatus for recovering energy of an exhaust gas from a blast furnace, which comprises a turbine into which a part of a gas discharged from a blast furnace, from which dusts have been removed, is supplied, a septum valve to which the remainder of the gas is supplied, a generator connected to the turbine, a governor valve for adjusting the flow rate of the gas supplied to the turbine, and means for selectively controlling the septum valve and the governor valve in response to a signal indicating the top pressure of the blast furnace which corresponds to the flow rate of the gas at the furnace top, said controlling means comprising a first oscillator for detecting the top pressure of the blast furnace and emitting a signal corresponding to the detected top pressure, a first signal changeover device connected to said first oscillator, a pressure governor for emitting a top pressure controlling signal to said first signal changeover device in response to the signal emitted from said first oscillator, a mechanism connected to said first signal changeover device to operate said septum valve, a second signal changeover device connected to said first signal changeover device, a mechanism connected to said second signal changeover device to operate the governor valve of the turbine, and a second oscillator connected to said second signal changeover device to detect the totation number of the turbine and emit a signal corresponding to the detected rotation number.

3. An energy recovery apparatus as set forth in claim 2, wherein the pressure governor is automatically and selectively connected to the governor-valve operating mechanism in response to the signal from the first oscillator in the first signal changeover device through the septum-valve operation mechanism or second signal changeover device.

4. An energy recovery apparatus as set forth in claim 3, wherein in the first signal changeover device the connection between the septum-valve operating mechanism and the pressure governor can be manually locked and unlocked.

5. An energy recovery apparatus as set forth in claim 2, wherein the second signal changeover device, the governor-valve operating mechanism is selectively connected to said second oscillator or said first signal changeover device.

6. An energy recovery apparatus as set forth in claim 2, wherein the flow rate of the exhaust gas passing through the septum valve is adjusted through the first oscillator, pressure governor and first signal changeover device, thereby to control the top pressure of the blast furnace.

7. An energy recovery apparatus as set forth in claim 2, wherein the flow rate of the exhaust gas passing through the governor valve is adjusted through the first oscillator, pressure governor, first signal changeover device and second signal changeover device, thereby to control the top pressure of the blast furnace.

* * * * *